United States Patent [19]

Lewis et al.

[11] Patent Number: 5,001,737

[45] Date of Patent: Mar. 19, 1991

[54] FOCUSING AND GUIDING X-RAYS WITH TAPERED CAPILLARIES

[76] Inventors: Aaron Lewis, 38 Woodcrest Ave., Ithaca, N.Y. 14850; Edward A. Stern, 9536 42nd NE., Seattle, Wash. 98115; Yizhak Yacoby, Physics Department, Hebrew University, Jerusalem, Israel

[21] Appl. No.: 492,401

[22] Filed: Mar. 7, 1990

Related U.S. Application Data

[63] Continuation of Ser. No. 261,146, Oct. 24, 1988, abandoned.

[51] Int. Cl.[5] ..... G21K 1/02; G21K 1/00; G21K 5/10; G21K 1/06

[52] U.S. Cl. ..... 378/147; 378/145; 378/149; 378/84

[58] Field of Search ..... 378/145, 147, 149, 137, 378/138, 84, 76; 250/505.1; 328/228, 229

[56] References Cited

U.S. PATENT DOCUMENTS

| | | | |
|---|---|---|---|
| 2,766,385 | 10/1956 | Herrnring et al. | 378/145 |
| 3,143,651 | 8/1964 | Giacconi et al. | 378/147 |
| 4,063,088 | 12/1977 | Dailey | 378/147 |
| 4,582,903 | 4/1986 | Dance et al. | 378/147 |
| 4,748,646 | 5/1988 | Osada et al. | 378/119 |
| 4,780,903 | 10/1988 | Soezima | 378/147 |
| 4,788,698 | 11/1988 | Kimura et al. | 378/145 |

FOREIGN PATENT DOCUMENTS

| | | | |
|---|---|---|---|
| 2115400 | 5/1987 | Japan | 378/145 |
| 88/01428 | 2/1988 | World Int. Prop. O. | 378/147 |

OTHER PUBLICATIONS

Coleman, G. et al., *X-Ray Output Lens*, IBM Technical Disclosure Bulletin, vol. 22, No. 8B, Jan. 1980.

Chase, R. C. et al., *Ellipsoid-Hyperboloid X-Ray Imaging Instrument for Laser Pellet Diagnostics*, Applied Optics, vol. 14, No. 9, Sep. 1975.

*Primary Examiner*—Edward P. Westin
*Assistant Examiner*—Don Wong
*Attorney, Agent, or Firm*—Jones, Tullar & Cooper

[57] ABSTRACT

Apparatus for directing and focusing X-rays by the new method of confinement is disclosed. A capillary having an inlet end and an outlet end with a generally tubular or rectangular inner wall surface defines a longitudinal central opening. The central opening is tapered inwardly from the inlet end to the outlet end. X-rays are directed into the inlet end at angles less than the critical glancing angle for the inner wall surface to direct X-rays through the capillary to a focus point near the capillary outlet end.

16 Claims, 3 Drawing Sheets

FOCUSING AND GUIDING X-RAYS WITH TAPERED CAPILLARIES

This application is a continuation of application Ser. No. 261,146, filed Oct. 24, 1988.

FIELD OF THE INVENTION

The present invention relates to a method and apparatus for focusing and guiding x-rays. More particularly, the invention is directed to the use of tapered capillaries having an inlet end on which x-rays are incident, the x-rays striking the inner surface of the capillary below the critical glancing angle and reflecting from the inner surface due to total external reflection. The capillary is tapered inwardly towards the outlet end so that the x-rays are focused in a broad band of energies. Greater focusing is possible with softer x-rays and from undulator sources.

BACKGROUND OF THE INVENTION

For many uses of x-rays, it is necessary or desirable to focus them into a small spatial region. The standard methods require very precise dimensions in the focusing elements, of the order of microns or less, and as a consequence such methods are difficult to achieve and expensive. The present invention is directed to a novel method and apparatus for focusing x-rays where the need for extreme precision is obviated, and as a result is cheaper and easier to fabricate. The apparatus also has a high efficiency of transmission.

The present invention is an extension of the recent progress that has been made in forming subwavelength beams of light with finely tapered glass capillaries. The use of untapered capillaries as light pipes for x-rays without focusing has previously been described in the art; however, the feasibility of using tapered capillaries to focus x-rays has not been reported.

SUMMARY OF THE INVENTION

The present invention is directed to a method and apparatus for focusing x-rays over a broad band of energies to dimensions of less than 0.1 microns, the exact dimension depending on the energy of the x-rays and the initial collimation of the x-rays before they enter the capillary. The method and apparatus may also be used for containing x-rays within a defined enclosure. Briefly, the invention provides a tapered capillary which may take several forms, the simplest of which is a small diameter glass tube which tapers linearly inwardly from an input end to an outlet end. The rate of taper is constant and, for a glass tube, the inner surface is totally reflective for x-rays striking that surface below the critical glancing angle. A more preferred form of the invention is a stepped capillary wherein the inner surface tapers in a series of steps, each having a different angle of linear taper so that for the first length of the tube, the inner surface has a first linear taper, for the next adjacent length, the inner surface has a second, steeper angle of taper, and so on for each adjacent length of the tube. The most preferred form of the invention incorporates a very large number of steps each having an increased degree of taper. The larger the number of steps, the more closely the shape of the inner surface of the capillary approaches an elliptical shape, which would be the most preferred form of the invention.

the capillary is internally reflective of x-rays which strike the mirror wall surface at less than the critical glancing angle so that x-rays which enter the inlet of the capillary at below this critical angle will be substantially completely reflected along the length of the capillary. Although there will be some loss of intensity due to reflection losses, thereby restricting the number of reflections that can be permitted as the x-ray travels through the capillary, these losses can be minimized by controlling the amount of taper. The advantage of such a taper, however, is that a focused beam is produced which provides a higher x-ray intensity in a smaller area at the outlet of the capillary.

The device of the present invention permits x-rays to be accurately directed so that they can be transmitted, diffracted, refracted, scattered, reflected or absorbed with a spatial resolution of between less than 0.1 micron and 100 microns, which resolution is characteristic of microprobe applications. The capillary also can serve to extend an x-ray source from its origin to another point in space in a way which is an analogous to the way an optical fiber transmits light. This allows the device to be used in, for example, medical applications that require focused x-ray spots without irradiating intervening tissue.

The device of the present invention maintains the polarization of the x-rays as they pass through the capillary, including linearly and circularly polarized x-rays.

The capillary provides a very fine focus point for the x-rays, enabling the capillary to function as an x-ray microscope for imaging, and to perform x-ray diffraction, x-ray absorption, x-ray tomography, x-ray fluorescence and x-ray absorption fine structure analysis with high spatial and time resolutions. The device can also be used as an x-ray amplifier and/or laser by incorporating media within the capillary that can be excited to produce x-ray emissions. The device can also be used as a source for non-linear excitation of transitions, and to investigate processes while they are rapidly evolving.

BRIEF DESCRIPTION OF THE DRAWINGS

The foregoing and additional objects, features and advantages of the present invention will become apparent to those of skill in the art from a consideration of the following detailed description of preferred embodiments thereof, taken in conjunction with the accompanying drawings, in which.

DSESCRIPTION OF PREFERRED EMBODIMENTS

Figure 1:
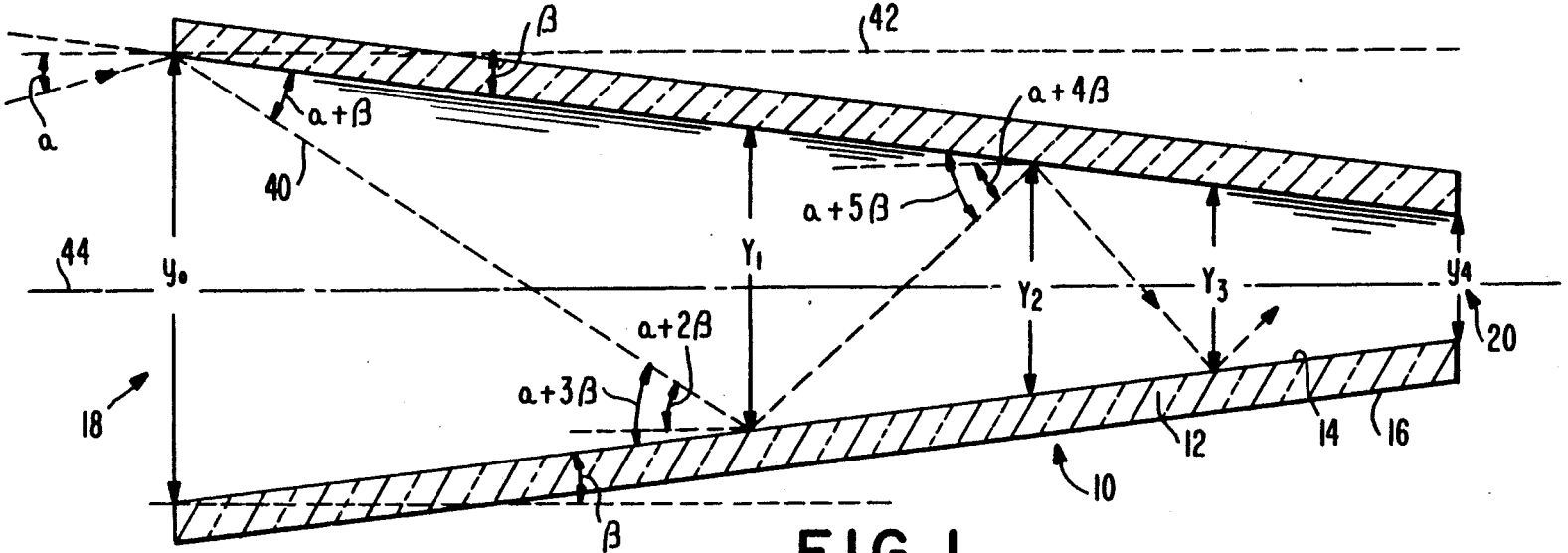
FIG. 1 is a diagrammmatic illustration of a linearly tapered capillary wherein the angle of divergence of the beam is represented by $\alpha$ and the angle of taper with respect to the horizontal is represented by the angle $\beta$.

FIG. 1 illustrates in diagrammatic form a tapered capillary 10 formed by a continuous glass wall 12 having an interior surface 14 and an exterior surface 16. The capillary has an inlet end generally indicated at 18 and an outlet end generally indicated at 20. As illustrated, the interior surface of the side wall 14 has a continuous, inward, linear taper from the inlet end 18 to the outlet end 20. The dimension of the capillary at the inlet end is indicated at $Y_O$, while the dimension at the outlet end is indicated at $Y_4$, with the dimension decreasing continuously from $Y_O$ to $Y_4$. The capillary may be tubular as illustrated in FIG. 1, in which case the dimensions $Y_O$ and $Y_4$ are its inner diameter, or it may be rectangular, in which case these dimensions are the height of the capillary inner passageway.

Figure 2:
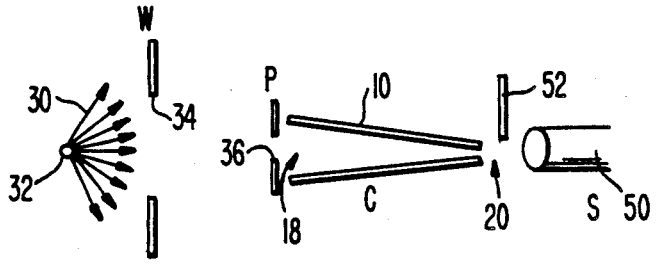
FIG. 2 is a diagrammatic illustration of an experimental layout for measuring x-ray intensities of beams transmitted through a capillary.

An experimental capillary assembly is illustrated diagrammatically in FIG. 2, wherein X-rays, indicated by the arrows 30, are emitted by a source 32, are directed through an aperture or window 34, and through a pinhole aperture 36 to effectively collimate the x-rays for entry into the capillary 10. X-rays entering the capillary follow various paths, depending upon their angle of approach, but typically follow a path such as that indicated by the dashed line 40 in FIG. 1. X-rays striking the inner surface of the capillary at an angle less than the critical glancing area will be reflected from the surface rather than entering the glass wall 12. Below this critical angle, any intensity loss upon reflection from surface 14 will be small, for the x-ray is almost completely reflected. The intensity profile of the beam at the outlet end is determined by measuring the signal in detector 50 as a function of the position of a polished edge stop 52.

In FIG. 1, the line 42 is parallel to the longitudinal axis 44 of the capillary and an incident x-ray enters the inlet at 18 at an angle $\alpha$ with the axis. By geometry it can be shown that after the first reflection at an inner capillary dimension $Y_O$ the next reflection will occur at an inner diameter $Y_1$ as indicated by the dotted line 40. The relationship of these two diameters is expressed as follows:

$$y_1/y_O = \sin[\alpha+\beta]/\sin[\alpha+3\beta] \qquad \text{Eq. 1}$$

The incident ray 40 will again be reflected from the surface 14 at diameter $Y_1$ and another cycle of reflections will take place. In this cycle, the ray is considered to be incident at the diameter $Y_1$, with the next reflection occurring at $Y_2$. The relationship between diameters $Y_1$ and $Y_2$ is given by:

$$y_2/y_1 = \sin[\alpha+3\beta/\sin[\alpha+5\beta] \qquad \text{Eq. 2}$$

Multiplying equations 1 and 2 together, one obtains:

$$y_2/y_O = \sin[\alpha+\beta]/\sin[\alpha+5\beta] \qquad \text{Eq. 3}$$

By induction it is easily seen that in general:

$$y_n/y_O = \sin[\alpha+\beta]/\sin[\alpha+(2n+1)\beta] \qquad \text{Eq. 4}$$

where $Y_n$ is the diameter of the capillary at the (N−1) th reflection, and $$[\alpha+(2n=1)\beta] \qquad \text{Eq. 5}$$

is the glancing angle at that reflection. In order to remain in the total reflection region the following is required:

$$\alpha+(2n+1)\beta \leqq \theta c \qquad \text{Eq. 6}$$

Since generally the critical angle for x-rays satisfies the requirement that $\theta c$ be much less than 1, we can approximate equation (4) as follows:

$$m_n 5\ y_n/y_O \approx (\alpha+\beta)/[\alpha+(2n+1)\beta] \qquad \text{Eq. 7}$$

or by the following approximation:

$$y_n[\alpha+(2n+1)\beta] = \text{constant.} \qquad \text{Eq. 8}$$

In all of the foregoing equations, the angle $\beta$ is the angle of the inner surface 14 with respect to the longitudinal axis of the capillary, and this angle represents the amount of taper in the capillary. The maximum demagnification $m_m$ (the minimum value of $Y_m/Y_O$) for a given angle $\beta$ is given by the following relationship:

$$m_m = (\alpha+\beta)/\theta_c \qquad \text{Eq. 9}$$

As an example of this demagnification consider the bending magnet radiation where the source 32 of x-rays is a synchroton, and whether $\alpha$ is approximately $0.5 \times 10^{-4}$ radians. With such an arrangement, the maximum demagnification as the angle approaches zero would be 1/80, since critical glancing angle $\theta c$ for glass is approximately $4 \times 10^{-3}$ *radians.*

Although theory indicates that losses for x-rays below the critical glancing angle are negligible, experimental results show that in fact they are larger than the ideal calculated values. Therefore, the optimum design for synchroton radiation will have to be one that does not include a large number of reflections. From the demagnification equation (9) it is apparent that for a perfectly parallel incident beam, where $\alpha=0$, an arbitrarily small spot size can be achieved simply by making the taper of the capillary very small so that the angle $\beta$ approaches zero. This in turn requires having a large number of reflections, but since reflections cause losses, this is to be avoided if possible. Conversely, if the number of reflections is to be reduced, $\beta$ has to be increased, and this increases the final spot size that can be achieved by a facotr of $(\alpha+\beta)/\alpha$. Accordingly to get the maximum intensity from a linear tapered capillary, there has to be a compromise between the taper and the number of reflections in order to get the smallest spot size with maximum put through. As indicated above, the intensity profile of the x-rays passing through the capillary may be measured by monitoring the signal in a target such as a detector 50 as a function of the position of the polished straight edge 52 of an x-ray absorbing material (see FIG. 2).

Figure 3:
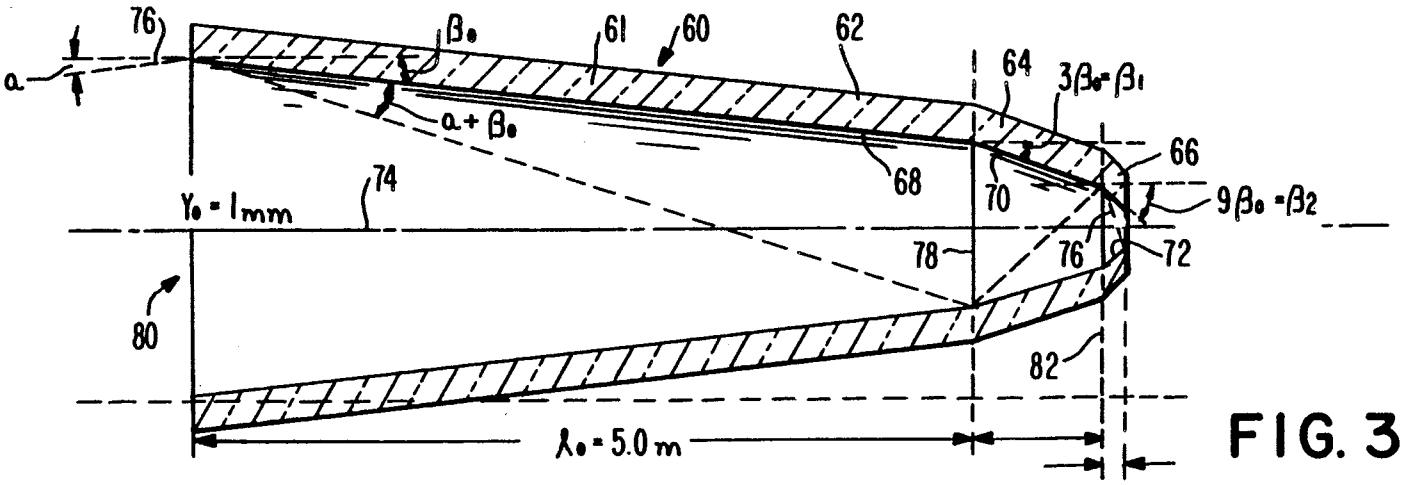
FIG. 3 is a diagrammatic illustration of a step-tapered capillary.

Improved results are obtained in the embodiment illustrated in FIG. 3, to which reference is now made. As illustrated, the capillary 60 includes a glass side wall 61 which includes stepped wall segments 62, 64 and 66, for example (a fourth segment is not shown). Each segment has an X-ray receiving, or inlet, end and an X-ray emitting, or outlet, end, with the outlet of each segment being connected to the receiving end of the next succeeding segment. The wall segments include corresponding inner wall surfaces 68, 70 and 72, respectively, each of which forms a different, and increasing, angle with respect to the longitudinal axis 74 of the capillary. Thus, for example, the inner wall surface 68 forms an angle $\beta_O$ with the axis, the wall section 70 forms an angle 3 $\beta_O$, and wall surface 72 forms an angle 9 $\beta_O$ as illustrated in FIG. 3.

As illustrated in FIG. 2, the source 32 produces numerous X-rays, but only those which pass through apertures 34 and 36 will be incident on the inlet end of the capillary. Some rays will enter the capillary near its axis, while others will enter the extreme edges of the inlet. The path 76 in FIG. 3 represents the path of an extreme X-ray and enters the capillary at, for example, an angle $\alpha$ which is less than the critical glancing angle. After a single reflection in a first linear taper defined by wall surface 68, the angle of the reflected x-ray beam with respect to the axis 74 will be increased, or enhanced, with the increase being from $\alpha$ to $\alpha+2\beta$. This increases the incident angle the x-ray makes with the surface of the first linear taper from $(\alpha+\beta)$ to $(\alpha+3\beta)$. This results in a demagnification $$\frac{y_1}{y_0} = \frac{(\alpha+\beta)}{\alpha+3\beta} \qquad \text{Eq. 10}$$

Each further reflection of the beam within the capillary will result in an increased incident angle, resulting in a corresponding decreasing demagnification per reflection. This is corrected for by increasing the taper $\beta$ along the capillary to match the new angle of incidence for each reflection, as illustrated in FIG. 3. In capillary 60, a step is provided at the point where the x-ray following path 76 makes its next reflection; this is, herefore, the junction 78 between segments 62 and 64 and corresponding wall surfaces 68 and 70. The path 76 represents the extreme reflection which occurs only once in each tapered portion; x-rays at smaller angles will have a smaller number of reflections in the segments.

For the stepped taper illustrated in FIG. 3, each segment receiving end is one half the diameter of the receiving end of the preceding segment; that is, the diameter at junction 78 is ½ the diameter at the inlet end 80 of the capillary. Similarly, the diameter at the junction 82 between the wall surface 70 and the wall surface 72 is ½ the diameter of the capillary at junction 78. Furthermore, the angle of incidence of the ray for each step relative to the axis of the capillary will be three times the angle in the previous step.

In the embodiment of FIG. 3, if $\alpha=0.5\times10^{-4}$ radians, the taper for the initial surface 68 is set to $\beta_0=0.5\times10^{-4}$ radians. The subsequent tapers are as follows:

$\beta_1=1.5\times10^{-4}$ radians $\beta_2=4.5\times10^{-4}$ radians $\beta_3=13.5\times10^{-4}$ radians For these sections of taper, the total demagnification $m_m=(\frac{1}{2})^4=1/16$, while the glancing angle of incidence at the last reflection at the junction 82 is $27\times10^4$ radians, still below the critical angle. Assuming no losses on reflection, this gives an intensity enhancement factor of $16^2$, or 256. A more realistic number as indicated by measurement of experimental capillaries is a 6% loss per reflection. This loss in relection adds a factor of 0.78, giving a total intensity enhancement per unit area of 200 at the output of the tapered capillary. This may be compared with the linear taper of FIG. 1 with the same demagnification factor, in which a loss in reflection factor of 0.50 is obtained for the 11 required reflections along the length of capillary, giving a total intensity enhancement per unit area of only 130.

Figure 4:
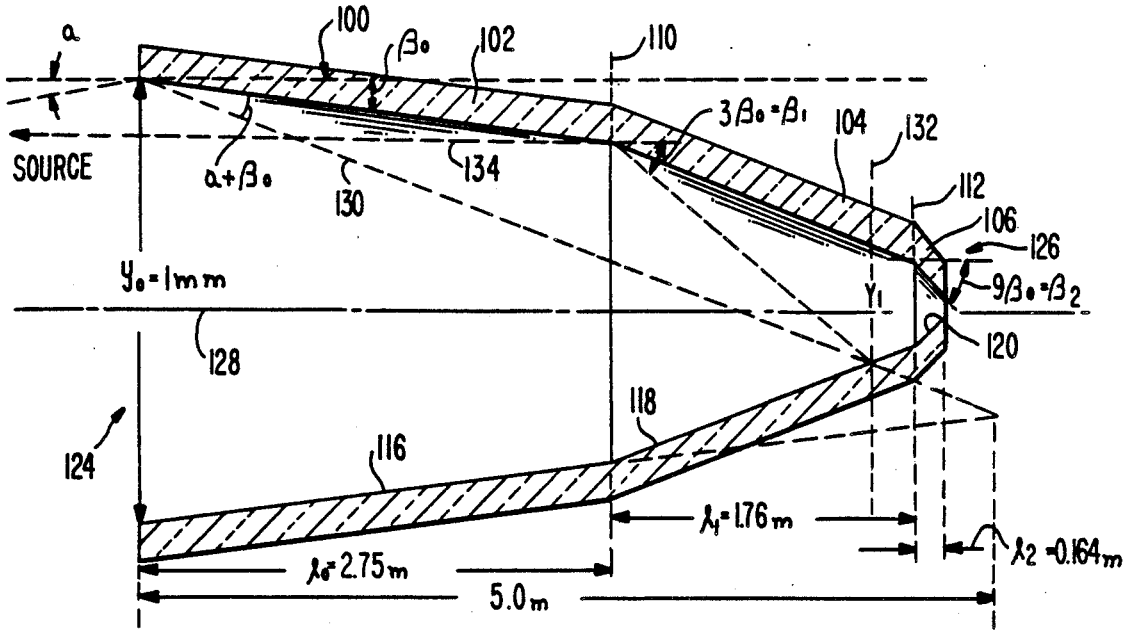
FIG. 4 is a diagrammatic illustration of an improved step-tapered capillary.

Still further improvement is illustrated in FIG. 4, wherein a capillary 100 incorporates sidewall segments 102, 104, and 106, (a fourth segment is not shown) joined together at junctions 110 and 112. The wall segments have interior surfaces 116, 118, and 120, respectively, which are joined together with the emitting end of one segments joining the receiving end of the next segment at the junctions 110 and 112. The capillary has an inlet end 124 and an outlet end 126, with a longitudinal axis 128.

In the embodiment of FIG. 3, the initial taper intersects the extreme ray represented by dotted line 76 only once. The limiting demagnification factor can be improved, in accordance with the embodiment of FIG. 4, with no increase in the number of reflections, if the step between adjacent segments of the wall is started sooner than the location where the extreme ray would make its next intersection if the taper were the same length as that of FIG. 3. Thus, the taper is stepped at junction 110 and the extreme ray represented by dotted line 130 does not strike the wall of the capillary until the region indicated by the line of intersection at 132 on surface 118. The ray 130 then strikes a wall section having a smaller diameter than was the case in the embodiment of FIG. 3, with a resulting greater demagnification, which is a positive gain for the purpose of the present invention. On the other hand, rays with a smaller incident angle such as those indicated by the dotted line 134, which are closer to being parallel to the capillary axis 128, will have their first reflection at the second tapered section 118, and from equation 4 such a ray will have a smaller demagnification. However, these rays at smaller incident angles are precisely the rays that require less demagnification. An ideal design would be one which matches these two requirements to make the final size the same for all rays.

A stepped approximation to this ideal is illustrated in FIG. 4 wherein each step occurs as $xl_i$, where is equal to 0, 1, 2, 3, etc., where $l_i$ is the tapered length of each step of the capillary of FIG. 3, and where x is approximately 0.55. For capillary 100, and with four reflections along the length of the capillary, the demagnification factor $m_m$ for a ray is 91, with the same reflection loss factor of 0.78. As a result, the total intensity enhancement per unit area on a target at the end of the capillary is 6,400. This optimized taper has a miximum demagnification factor $m_m$ that is larger than the value 80 for the limiting linear taper. In fact, the taper in FIG. 4 is the beginning of an approximation to the ideal focusing element in which the wall surfaces 116, 118 and 120 form an ellipse. A device such as that illustrated in FIG. 4 would operate with an x-ray source of an electron bunch from a synchrotron radiation ring which would typically be 0.1 mm in diameter. A part of an elliptically shaped surface of rotation theoretically could focus by imaging a spot of 10 μm diameter from a source of 0.1 mm. However, such a focusing element would require extreme dimensional precision. Such precision is not necessary for the tapered stepped capillary illustrated in FIG. 4, which does not image, but focuses by guiding within the capillary. The following table sets forth exemplary parameters for the construction of tapered capillaries in accordance with FIGS. 3 and 4:

TABLE I

| | | | | | |
|---|---|---|---|---|---|
| FIG. 3 STEP-TAPER ($\beta o = 0.5 \times 10 - 4$) | Taper | $\beta o$ | 3 $\beta o$ | 9 $\beta o$ | 27 $\beta o$ |
| | Length (meters) | 5.00 | 0.832 | 0.139 | 0.0230 |
| FIG. 4 STEP-TAPER ($\beta o = 0.5 \times 10 - 4$) | Taper | $\beta o$ | 3 $\beta o$ | 9 $\beta o$ | 27 $\beta o$ |
| | Length (meters) | 2.75 | 1.76 | 0.164 | 0.0172 |

As explained above, the advantages of capillary focusing are its inexpensive cost, simplicity of fabrication compared to other methods, high throughput, and broad bandpass characteristics. Its inexpensive cost and simplicity of fabrication are related to the fact that it does not require the extreme precision of dimension or shape that is necessary in other currently available methods such as mirrors and zone plates. For example, in mirrors and zone plates, and inaccuracy which causes a deviation of the x-ray wave front will ruin the focus since such devices are placed relatively far away from the focal point; that is, on the order magnitude of meters or centimeters. On the other hand, in the present invention such accuracy is not required, since the sample to be irradiated can be placed a fraction of a millimeter from the capillary output. Thus, any variation in shape or non-specular scattering will still confine the x-rays within the capillary and as long as they exit from the tip, they will still contribute to the focus.

The maximum focus possible by the capillary is limited by the critical angle $\theta_c$, as explained in equation 9. Thus, $m_m$ can be increased if $\alpha$, which is the divergence of an x-ray beam from the axis of the capillary, is made smaller so that $\beta$ can be decreased. Typically one desires to have $\beta$ approximately equal to $\alpha$. The insertion of devices in synchrotron radiation rings, such as undulators, give outputs with smaller values of $\alpha$ than are obtained from bending magnets. Therefore, with such devices and with the present technique, very small focused x-ray spots can be achieved. An alternate way to increase $m_m$ is to increase $\theta c$. The expression of $\theta_c$ is given by:

$$\theta_c = (4\pi ne^2/m)^{\frac{1}{2}}/\omega \qquad \text{Eq. 11}$$

where n is the effective electron density per unit volume. $\omega$ is the angular frequency of the x-rays, and e and m are the electron charge and mass respectively. From equation 11 it is seen that there are two ways increase $\theta c$. One is to increase n and the other is to increase $\omega$. The dependence on n goes as the square root and the improvement by changing the material on the inner surface of the capillary is limited to practice, to a factor of 2.5. However, the dependence of $\omega$ is inverse and an order to magnitude increase in $m_m$ is possible by using softer x-rays.

In an experimental test of the invention, a conventional fixed anode x-ray source was used. Such a source does not have the collimation inherent in synchrotron x-ray radiation. However, the effectiveness of the present method was demostrated with such a source. For this non-collimated beam using a constant bore capillary; i.e., a capillary without a taper, focusing occurs because of the increase of the effective solid angle at the output of the capillary compared to a pinhole of the same diameter located at the caillary output. If no losses are assumed in the reflectivity, the increase in intensity is given by the ratio of the solid angle subtended by $\theta_c$ to that subtended by the capillary exit. For these measurements, a glass capillary having a constant bore of 0.88 mm, where $\beta$ approached zero, with a length of 64 cm was used. For this capillary, the critical angle was calculated to be $4\times10^{-3}$ radians for Cu$\alpha$ radiation and the relectivity at this angle was calculated to be 97.5%. Although measurements on a constant bore glass tube have previously been reported, those measurements were made on tubes having larger diameters which were composed of six sections mechanically aligned to one another. The connection between sections introduced some discontinuities whose effects, though small, were uncertain.

Figure 5:
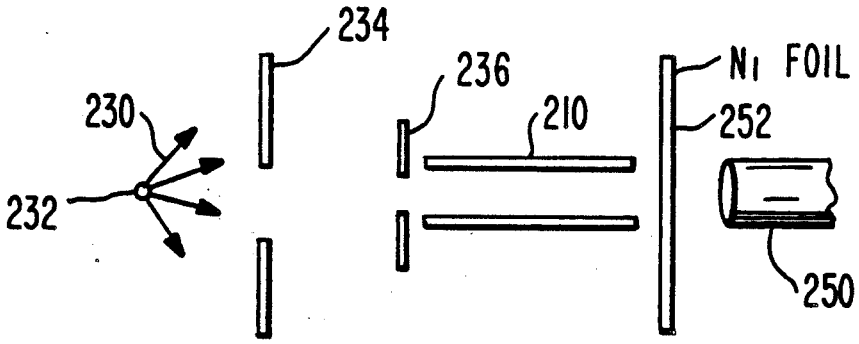
FIG. 5 illustrates in schematic form an experimental arrangement for testing the present invention.

The experimental arrangement is schematically illustrated in FIG. 5, wherein the x-ray source 232 is a 1 mm by 1 mm point focus of a Cu traget Philips x-ray tube, operated on a Philips PW 1300 x-ray generator at 20 KeV and 4 mA. In this experimental arrangement, all rays that enter the capillary 210 at incident angles below the critical angle should be transmitted through the tube through the outlet end. For measurement of the capillary throughput, a pinhole 236 which was 0.1 mm in diameter was placed at a distance of 130 mm, plus or minus 3 mm from the center of the x-ray tube, with the pinhole emitting an x-ray beam of angular width of approximately $1.1/130 = 8.5\times10^{31\ 3}$ radians which is slightly more (by 5%) than the angular acceptance of the glass capillary, this angular acceptance being twice the critical angle. A constant bore capillary 210 was placed on a groove in an aluminum tray, which in turn rested on two jacks and microslides, permitting fine positioning of the device in both directions perpendicular to the beam and independently at each end of the capillary. The entrance tip of the capillary touched the pinhole. The scintillation counter was positioned at distance of 5 cm from the exit tip. Four nickel foils were placed in front of the counter window, decreasing the incident Cu k intensity by about 80% and enhancing the monochromaticity of the beam.

Measurements were conducted by first removing the capillary, maintaining the pinhole at its same position and observing the x-ray intensity $I_o$ at the counter which subtended a large enough solid angle to detect all of the radiation that passed through the pinhole (pinhole to counter distance 69 cm). It was noted that the intensity $I_o$ remained constant to within 3% on moving the pinhole about 3 mm in each of the two perpendicular directions to the beam.

Subsequently, the capillary was replaced between the pinhole and the counter and after some adjustment of its alignment an x-ray intensity was observed to pass through the capillary as evidenced by the counting rate of the scintillation counter rate $I_c$ was reached and measured. The capillary was then removed again and the counting rate $I_o$ was redetermined, resulting in the same value as the first measurement.

Both the values for Io and Ic were measured four times for 100 secs each, giving an accuracy in counting statistics better than 0.1%. The observed rates are $I_o = 10155$ plus or minus 5 counts/sec and $I_c = 7880$ plus or minus 5 counts/sec. Since both $I_o$ and $I_c$ were measured under the same absorption length in air they can be compared directly. Considering the fact that 95% of the incident intensity hits the capillary below the critical angle and on the average a ray should be reflected between 2 to 3 times based on the length and cross-section of the capillary, the theoretical ratio between $I_c/I_o$ should be 0.84 assuming 0.975 for the reflectivity. The actual values of $I_c/I_o$ about give a ratio of 0.76 plus or minus 0.01 which is smaller than the theoretical value, as expected.

The difference between the theory and experiment is a result of deviations in the experimental situation from the ideal. These deviations are due to roughness of the capillary surface and imperfect alignment which includes slight bending of the capillary and undulations through its length. The intensity enhancement at the exit of the capillary as compared to the intensity from a pinhole placed at the same position as the capillary exit was a factor of $(2\theta c)^2 \times (0.088/64)^2 \times (0.78/0.9) = 29!$ The factor 0.88/0.64 is the angle subtended by the exit diameter at the pinhole, which is a distance of 64 cm. The factor 0.78/0.9 is a result of the losses within the capillary and the 2 $\theta c$ is the angle subtended by the rays that totally reflect within the capillary.

Figure 6:
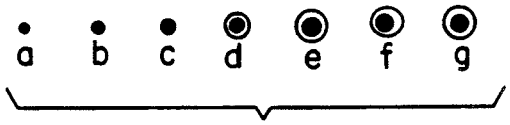
FIG. 6 illustrates in steps a. through g. the focusing capability of the device of the present invention at different distances from the outlet of the capillary.

Exposures taken at distances of 0, 5, 10, 15, 20, 25 and 30 cm from the outlet 220 of the capillary are indicated in FIG. 6 at points a–g. As illustrated, the greatest degree of focusing occurred at about 5 cm, with the spot produced by the x-ray beam increasing gradually in size with distance from the exit. It was noted that the intensity at the output end was sensitive to the relative position of the pinhole and the capillary. Thus, it has been demonstrated the x-rays can be focused and guided by a glass capillary.

Figure 7:
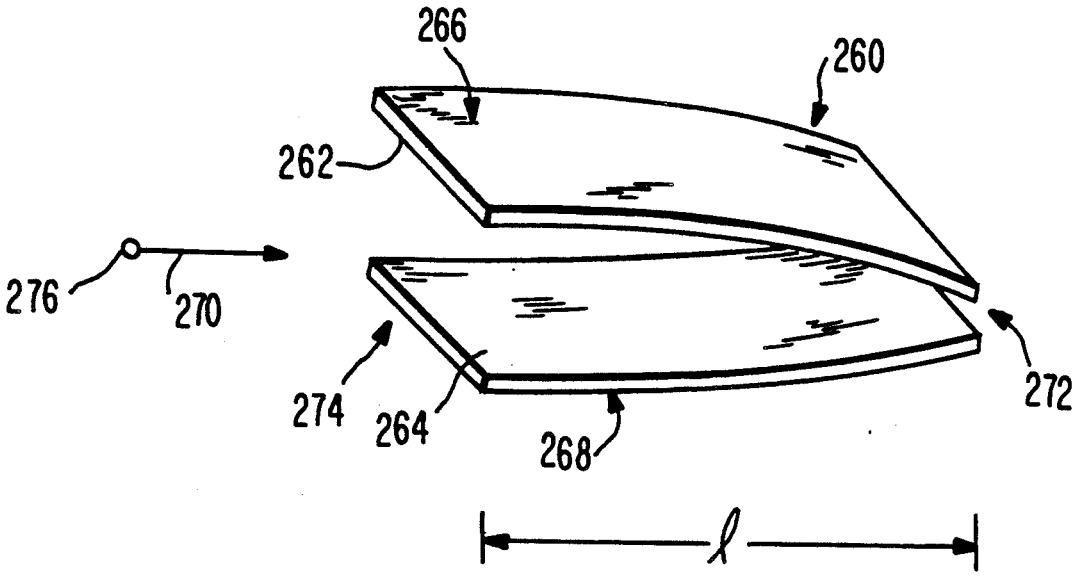
FIG. 7 illustrates a capillary constructed to taper in only one dimension, in accordance with the present invention.

In addition to the tubular or rectangular capillary which focuses in two dimensions by tapering in two dimensions, it is simpler to construct a one dimensional focusing element by tapering in one dimension. Such a one dimensional focusing element, which is diagrammatically illustrated in FIG. 7 at 260, can be bent into the desired tapers including the more ideal elliptical shape, greatly simplifying the construction of the element. The inner surfaces 262 and 264 between the two plates 266 and 268, respectively of flat and polished glass are bent in the more ideal elliptical shape given by the equation $$\frac{x^2}{A^2} + \frac{y^2}{B^2} = 1 \qquad \text{Eq. 12}$$

where x and y define a vertical plane. The direction of the x-rays make only small angles to the horizontal x-axis and they focus in the y-direction. The horizontal z direction is perpendicular to the x-y plane and there is no focusing in that direction. The slope from the horizontal of the inner surface at the outlet is equal to the cirtical angle $\theta c$ for total external reflection of the x-rays, 270, which typically is $4 \times 10^{-3}$ radians, and the opening 272 at the outlet is 10 $\mu$m in the vertical direction. The opening 274 at the inlet is 500 $\mu$m in the vertical direction. To produce such an elliptical shape $A^2 = 5 \times 10^{13} \mu m^2$, $B^2 = 1.4 \times 10^5 \mu m^2$, and the length l of the focusing element in the x-direction, the longitudinal direction, is 1.8 m. This shape is suitable for an arrangement where the x-ray source 276 and the outlet 272 of the one dimensional focusing element are approximately 15 m for one another.

Although the present invention has been disclosed in terms of preferred embodiments, variations and modifications may be made without departing from the true spirit and scope thereof as set forth in the following claims.

What is claimed is:

1. Apparatus for directing and concentrating X-rays comprising:

a capillary having an open inlet end and outlet end and having an inner wall surface defining a longitudinal central opening, said capillary central opening being tapered inwardly in steps from said inlet to said outlet end to gradually reduce the dimensions of the capillary central opening, said inlet taper of each of said steps being linear, the angle of taper of each step being about three times the angle of taper of its immediately preceding step, the length of a first of said steps at said input end being less than the length of the path of travel of an X-ray beam within the capillary from its point of first impingement on said inner wall surface at an angle below a critical glancing angle of said inner wall surface and a point of second impingement on said inner wall surface; and means directing X-rays into said capillary inlet at angles less than said critical glancing angle for said inner wall surface, the linear taper of said central opening directing said X-rays through said capillary and concentrating all said X-rays to exit at said capillary outlet end.

2. The apparatus of claim 1, wherein said inner wall surface is generally tubular.

3. The apparatus of claim 1, wherein said inner wall surface is rectangular in cross-section.

4. An elongated capillary for directing and concentrating X-rays, comprising:

an open inlet at a first end of said capillary, said open end having a first cross-sectional dimension for receiving X-rays;

an open outlet at a second end of said capillary, said outlet end having second cross-sectional dimension defining an area of focus, said second dimension being smaller than said first dimension;

a continuous X-ray reflective inner wall surface defining a longitudinal central opening for said capillary, said central opening having a longitudinal axis and said wall surface having an inward taper from said inlet end to said outlet end; and means directing X-rays of a first concentration into said capillary central opening throughout said inlet end at angles less than the critical glancing angle for the wall surface of said central opening, the taper and reflective surface of said central opening wall directing said X-rays through said capillary and progressively confining said X-rays to provide at said outlet end a beam of a second concentration greater than said first concentration, said outlet beam having a cross-sectional dimension which is at least as small as the cross-sectional dimension of said outlet end.

5. The capillary of claim 4, wherein said opening is tapered in steps from said inlet end to said outlet end, each step comprising a capillary segment which is linearly and continuously tapered and which has an X-ray receiving end and an X-ray emittingy end, with the emitting end of each segment having a cross-sectional dimension which is one-half the cross-sectional dimension of the receiving end thereof, and wherein the taper of each segment has a taper angle three times the taper angle of the next preceding segment.

6. The capillary of claim 5, wherein said means directing X-rays into said capillary comprises a collimated synchrotron source of X-rays.

7. The capillary of claim 6, wherein said synchrotron source is located to direct X-rays into said inlet end along said axis, the taper of the inner wall surface of each of said segments deflecting X-rays approaching said wall segments at said glancing angle or less inwardly toward said axis to concentrate said X-rays at said outlet end.

8. The capillary of claim 7, wherein said outlet end has a dimension from about 10 microns to about 0.1 micron.

9. The capillary of claim 8, wherein said inner wall surface taper for each segment directs said X-rays to concentrate said X-rays without a common focal point.

10. A method of concentrating X-rays to increase the intensity of an X-ray beam without point focusing the X-rays, comprising:

directing a beam of X-rays from a source into an open inlet end of a capillary having an inner surface defining a central through opening, said capillary opening to a capillary opening having an outlet end;

tapering the inner surface of the central opening through the capillary inwardly to decrease the cross-sectional dimension of the capillary through opening from its inlet end to its outlet end to thereby constrict the path of the X-ray beam;

causing said beam of X-rays from said source to impinge on the inner surface of the capillary at angles below the critical angle of total external reflection of the inner surface so that the beam is reflected from the inner surface and travels through the capillary from its inlet end to its outlet end, the constricted path reducing the cross-sectional dimension of the beam as the beam passes along the capillary to thereby produce an output beam at the output of the capillary having a higher intensity than the beam of X-rays directed to the open input end of the capillary.—Rewrite claim 20 as follows:

11. The method of claim 10 wherein the step of tapering the inner surface of said central opening includes forming the capillary in a series of tapered steps approximating an elliptical shape to thereby constrict said X-ray beam without producing a point focus.

12. The method of claim 11, wherein the step of causing the X-rays to enter the capillary includes directing X-rays to enter the entire cross-sectional area of the inlet end of said capillary at angles to impinge on various locations on said inner surface of said capillary.

13. The method of claim 12, wherein at least some of said X-rays impinge on said inner surface a plurality of times in travelling through said capillary.

14. The method of claim 10, wherein the step of tapering the path of said X-rays includes forming the capillary with a cross-section that decreases along the length of the capillary to provide an outlet opening having a dimension equivalent to the dimension of a focal point for the X-rays, the taper of the capillary inner surface constricting the beam dimension to the dimension of the outlet opening without focusing the beam.

15. The method of claim 10, wherein the step of tapering the path of said X-rays includes forming the capillary with a pair of opposed surfaces which are inwardly tapered to produce a cross-section that decreases in one dimension along the length of the capillary to provide an outlet opening having one dimension equivalent to the dimension of a focal point for the X-rays, the taper of the capillary inner surface constricting the beam in said one dimension without focusing the beam.

16. The method of claim 10, wherein the step of tapering the path of said X-rays inlcudes forming the capillary with a generally tubular inner surface which is generally tapered inwardly to produce a cross-section that decrease in two dimensions along the length of the capillary to provide an outlet opening having its dimensions equivalent to the dimension of a focal point for the X-rays, the taper of the capillary inner surface constricting the beam in two dimensions without focusing the beam.

* * * * *